United States Patent [19]

Zagami

[11] 3,995,764

[45] Dec. 7, 1976

[54] SELF-CONTAINED GARBAGE CAN COVER

[76] Inventor: Johnnie Zagami, c/o George Spector, 3615 Woolworth Bldg., 233 Broadway, New York, N.Y. 10007

[22] Filed: Nov. 11, 1974

[21] Appl. No.: 522,443

[52] U.S. Cl. ..... 220/263; 220/331; 220/346; 220/1 T

[51] Int. Cl.[2] ..... B65D 43/16

[58] Field of Search ..... 220/331, 252, 324, 345, 220/346, 347, 348, 260, 263, 1 T

[56] References Cited

UNITED STATES PATENTS

| | | | |
|---|---|---|---|
| 2,003,770 | 6/1935 | Goodhart | 220/324 |
| 2,049,080 | 7/1936 | Pickup | 220/331 |
| 2,568,276 | 9/1951 | Eggleston | 220/331 |
| 2,804,230 | 8/1957 | Attias et al. | 220/331 |
| 2,851,700 | 9/1958 | Denison | 220/331 |
| 3,131,841 | 5/1964 | Grogan | 220/331 |
| 3,384,385 | 5/1968 | Cohen et al. | 220/331 |
| 3,812,963 | 5/1974 | Zahuranec | 220/346 |

FOREIGN PATENTS OR APPLICATIONS

| | | | |
|---|---|---|---|
| 898,733 | 1945 | France | 220/331 |
| 53,824 | 8/1942 | Netherlands | 220/346 |
| 12,521 | 6/1894 | United Kingdom | 220/346 |

*Primary Examiner*—George E. Lowrance
*Assistant Examiner*—Joseph M. Moy

[57] ABSTRACT

An improved garbage can having a cover that is retractable into a side wall of the can when the can is wished to be opened up; thus eliminating the cover from being separated from the can and becoming blown away in a high wind.

1 Claim, 6 Drawing Figures

10
11
12
13
14
15
16
17
18
19
20
21
22
23
24
25
26
27
28
29
30
31
32
A
B
C
3
5

SELF-CONTAINED GARBAGE CAN COVER

This invention relates generally to garbage cans.

It is well known that a conventional garbage can has a removable lid or cover, which sometimes becomes blown away in a high wind and is lost, or at other times it may be knocked off by stray animals foraging through the garbage for food, thus resulting in need to clean up the scattered mess. This is all objectionable so is in need of an improvement.

Accordingly, it is a principle object of the present invention to provide a self contained garbage can cover wherein the cover is permanently connected to the can so that it cannot be separated therefrom and become lost, or run over by passing vehicles.

Another object is to provide a self contained garbage can cover wherein the cover retracts into the can side wall when the can is wished to be opened so that it is out of the way, and when a refuse collector or sanitation men dump it into the garbage truck, the cover is not thrown about and become banged up; also it eliminates the noise of thrown down covers, so that if collection is at night, it does not disturb sleepers.

Other objects are to provide a self-contained garbage can cover which is simple in design, inexpensive to manufacture, rugged in construction, easy to use and efficient in operation.

These and other objects will be readily evident upon a study of the following specification and the accompanying drawing wherein.

Figures 1, 2, 3, 4, 5, 6:
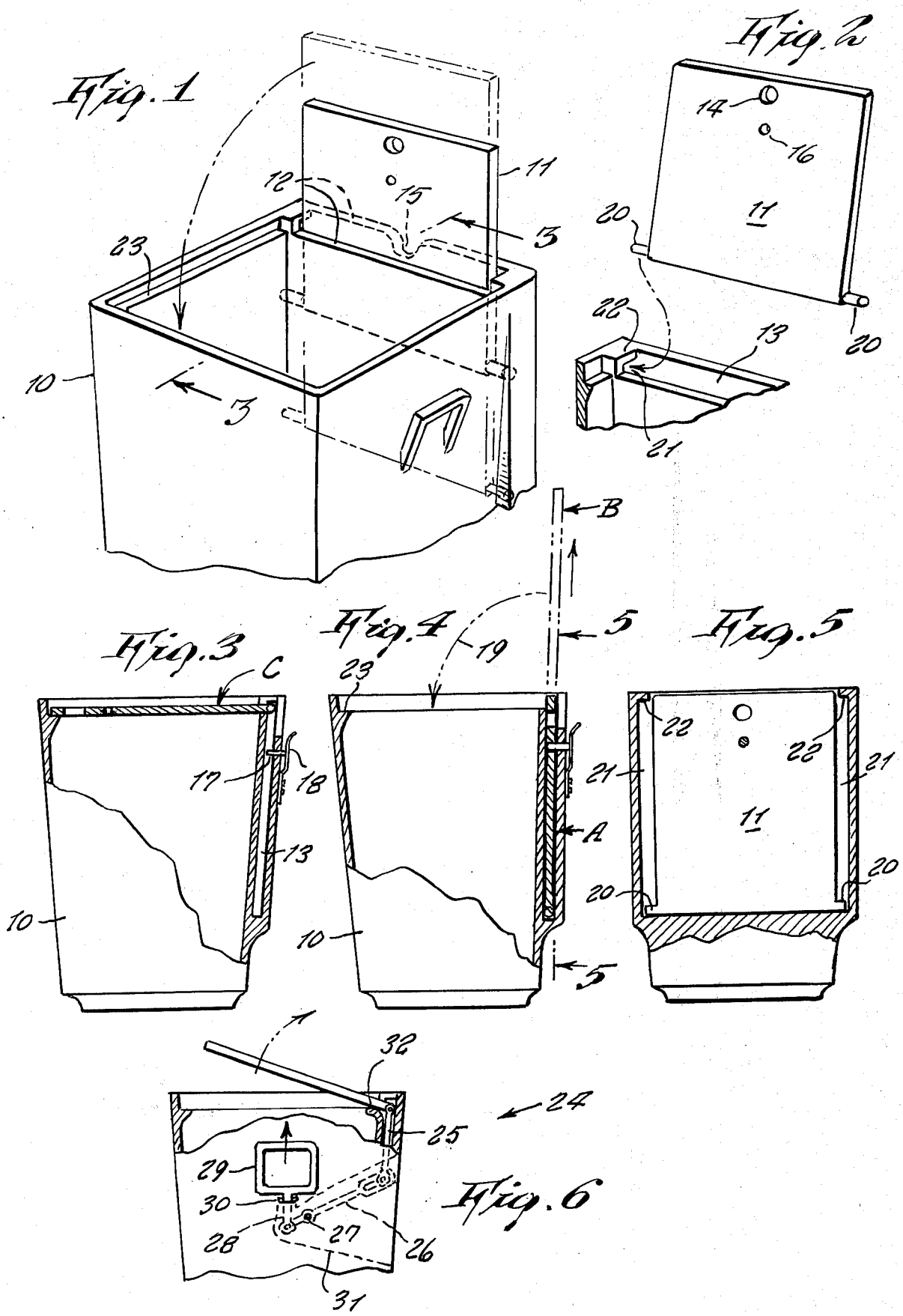
FIG. 1 is a perspective view of the invention shown with cover partly in stored away position.
FIG. 2 is a view showing details of the can and cover for interfitting together.
FIG. 3 is a cross section on line 3—3 of FIG. 1, and showing the cover closing the can.
FIG. 4 is a similar view thereof showing the cover fully stored away.
FIG. 5 is a cross section on line 5—5 of FIG. 4.
FIG. 6 is a side view partly in cross section showing a modified design of the invention wherein the cover automatically moves into stored away position when the can is lifted by its handles such as by a refuse collector.

Referring now to the drawing in detail, and more particularly to FIGS. 1 through 5 at this time, the reference numeral 10 represents a garbage can according to the present invention wherein the same is closable by a lid or cover 11 and permanently connected thereto.

The can includes a side wall 12 having a hollow pocket 13 into which the cover can completely be retracted so to not protrude in any way and become damaged while the can is turned over during a dumping action. The cover includes an opening 14 for receiving a finger and the can has a clearance notch 15 for aligning with opening 14 when the cover is fully recessed so that the finger can easily pull the cover out of the pocket. Another opening 16 through the cover serves to be engaged by a pin 17 of a spring catch 18 when the cover is retracted so that it does not slide out of the pocket while the can is up side down. To lift the cover from the picket, the hand simply pulls out the spring catch while a finger is placed into the opening 14, thus allowing the cover to be upwardly raised from the position A of FIG. 4 to the position B (shown in dotted lines in FIG. 4) so that the cover can then be pivoted downward (as shown by arrow 19) so that the cover closes the can (as shown at C in FIG. 3).

The cover includes sideward projecting pins 20 on each side which slide within opposite side grooves 21 of the pocket 13 and which abut against the underside of a small top wall 22 located over each of the grooves 21, thus preventing the cover to disengage from the can. When the pins 20 are in abuttment with the top walls 22 (such as at position B in FIG. 4), the cover then can pivot about the pins 20, thus held in the side grooves.

When the cover closes the can, it rests upon a shoulder 23 of the can.

In FIG. 6, a modified design 24 of the invention includes the can pocket 13 with its grooves 21, and the cover 11 together with its side pins 20.

However, in this form of the invention, the cover 11 is pivotally connected at its pivot end edge to a link 25 located in the pocket 13 and which is connected pivotally to one end of a rocker lever 26 pivotable about a pin 27 stationarily affixed in the can. An opposite end of the lever is pivotably connected to a projection 28 integral with handle 29 and which extend through an opening 30 into a side pocket 31 that contains the pivotable lever.

Thus in this form of the invention when the refuse-filled can is lifted by its handles for being dumped, the cover automatically pivots around the fulcrum 32 located a short distance away from the pivoting side pins 20, so to eliminate doing this chore by hand.

Thus a modified design is presented.

While various changes may be made in the detail construction, it is understood that such changes will be within the spirit and scope of the present invention as is defined by the appended claims.

What is claimed is:

1. In a self-contained garbage can cover assembly, the combination of a garbage can having a top edge about a refuse opening and a cover pivotally connected to said can, said can having a pocket on its side wall into which said cover is fully slidable when said can is in an opened position, said cover having spaced aligned transverse pins projecting laterally therefrom, said pins being slidable in vertical grooves adjacent each side of said pocket, a pair of stops at the upper ends of said grooves against which said pins abut when said cover is fully raised from said pocket, said cover being pivotable about said side pins when in abuttment with said stops, including a shoulder encompassing said top edge of said refuse opening, said cover resting upon said shoulder when pivoted into a horizontal position so as to close said can opening, including a movable handle mounted externally on said can including means connection said handle and cover whereby upward movement of said handle retracts the cover into the pocket, wherein a rear edge of said cover is connected pivotally to a link located in said pocket, said link being pivottally connected to one end of a rocker lever centrally pivotable about a fixed pin supported on said can, an opposite end of said lever being pivotally connected to a projection integral with said handle, said projection extending through an opening through said can rocker lever.

* * * * *